US008739855B2

(12) United States Patent
Fritz et al.

(10) Patent No.: US 8,739,855 B2
(45) Date of Patent: Jun. 3, 2014

(54) MICROCHANNEL HEAT EXCHANGER

(75) Inventors: Steve L. Fritz, St. Charles, MO (US); Matthew J. DeKam, Richfield, MN (US)

(73) Assignee: Hussmann Corporation, Bridgeton, MO (US)

( * ) Notice: Subject to any disclaimer, the term of this patent is extended or adjusted under 35 U.S.C. 154(b) by 135 days.

(21) Appl. No.: 13/402,966

(22) Filed: Feb. 23, 2012

(65) Prior Publication Data

US 2013/0213073 A1 Aug. 22, 2013

Related U.S. Application Data

(60) Provisional application No. 61/600,279, filed on Feb. 17, 2012.

(51) Int. Cl.
*F24D 19/02* (2006.01)
*F28D 1/04* (2006.01)

(52) U.S. Cl.
USPC ..... 165/55; 165/151; 165/152; 165/153; 165/97; 62/246; 62/255; 62/257

(58) Field of Classification Search
USPC ..... 165/55, 151–153, 97; 62/246, 255, 257, 62/312, 116, 285, 297
See application file for complete search history.

(56) References Cited

U.S. PATENT DOCUMENTS 2,447,759 A * 8/1948 MacMaster ..... 62/256
3,218,822 A * 11/1965 Bently et al. ..... 62/256
5,279,360 A 1/1994 Hughes et al.
6,216,343 B1 4/2001 Leland et al.
6,789,614 B2 * 9/2004 Sin et al. ..... 165/151
6,912,864 B2 * 7/2005 Roche et al. ..... 62/256
7,143,605 B2 12/2006 Rohrer et al.
7,201,015 B2 4/2007 Feldman et al.
7,281,387 B2 10/2007 Daddis, Jr. et al.
7,406,835 B2 * 8/2008 Allen et al. ..... 62/179
7,506,683 B2 * 3/2009 Hu ..... 165/140
7,640,970 B2 1/2010 Kim et al.
7,980,094 B2 * 7/2011 Yanik et al. ..... 62/506
2004/0261983 A1 * 12/2004 Hu ..... 165/148
2005/0000238 A1 * 1/2005 Schmid et al. ..... 62/272
2008/0141708 A1 * 6/2008 Obosu et al. ..... 62/498
2010/0011804 A1 1/2010 Taras et al.
2010/0012305 A1 1/2010 Taras et al.
2010/0024468 A1 2/2010 Scarcella et al.
2010/0064712 A1 * 3/2010 Esformes ..... 62/255
2010/0139313 A1 6/2010 Taras
2010/0252242 A1 10/2010 Xiangxun et al.
2010/0288471 A1 11/2010 Summerer
2011/0017438 A1 1/2011 Huazhao et al.
2011/0030420 A1 2/2011 Kirkwood
2011/0108260 A1 5/2011 Alahyari
2011/0127015 A1 6/2011 Taras et al.

* cited by examiner

*Primary Examiner* — Cassey D Bauer
*Assistant Examiner* — Steve Tanenbaum
(74) *Attorney, Agent, or Firm* — Michael Best & Friedrich LLP

(57) ABSTRACT

A heat exchanger includes an inlet header configured to receive a cooling fluid and an outlet header configured to discharge the cooling fluid. A plurality of microchannel tubes are in fluid communication with and extend between the inlet header and the outlet header. The microchannel tubes define a first heat exchanger region and a second heat exchanger region between the inlet header and the outlet header. The first heat exchanger region has a plurality of fins defining a first fin density that is greater than a second fin density of the second heat exchanger region.

8 Claims, 9 Drawing Sheets

MICROCHANNEL HEAT EXCHANGER

RELATED APPLICATIONS

The present application claims the benefit of U.S. Provisional Patent Application No. 61/600,279, filed Feb. 17, 2012, which is incorporated herein by reference in its entirety.

BACKGROUND

The present invention relates to a heat exchanger, and more particularly to a microchannel heat exchanger for use as an evaporator under conditions in which moisture is present, such as within a refrigerated merchandiser.

Refrigerated merchandisers are used by grocers to store and display food items in a product display area that must be kept at a predetermined temperature. These merchandisers generally include a case that has an integrated refrigeration system.

Microchannel heat exchangers include an array of aligned microchannel flow tubes, the ends of which are connected to an inlet manifold or header and an outlet manifold or header, respectively. Fins are brazed between the tubes, and at low operating temperatures, the heat exchanger is susceptible to frost formation, especially near the air inlet to the heat exchanger. Such frost formation can damage the evaporator and necessitate more frequent and thorough defrost cycles.

SUMMARY

The invention provides, in one aspect, a cooling system including a first flue and a second flue cooperatively defining an air passageway. A fan is disposed in the air passageway to generate an airflow through the first and second flue. The system further includes an evaporator in communication with at least one of the first flue and the second flue for cooling the airflow. The evaporator includes an inlet header configured to receive a cooling fluid and an outlet header configured to discharge the cooling fluid. A plurality of microchannel tubes are in fluid communication with and extend between the inlet header and the outlet header. The microchannel tubes define a first side of the heat exchanger between the inlet header and the outlet header and an opposed second side of the heat exchanger between the inlet header and the outlet header. The evaporator is positioned in the air passageway such that the airflow passes from the first side to the second side and then passes from the second side to the first side.

The invention provides, in another aspect, a heat exchanger including an inlet header configured to receive a cooling fluid and an outlet header configured to discharge the cooling fluid. A plurality of microchannel tubes are in fluid communication with and extend between the inlet header and the outlet header. The microchannel tubes define a first heat exchanger region and a second heat exchanger region between the inlet header and the outlet header. The first heat exchanger region has a plurality of fins defining a first fin density that is greater than a second fin density of the second heat exchanger region.

The invention provides, in another aspect, a refrigerated merchandiser including a case defining a product display area and having a first flue and a second flue cooperatively defining an air passageway internal to the case and in fluid communication with the product display area. The refrigerated merchandiser includes a fan for generating an airflow within the air passageway and an evaporator disposed in the case for cooling the airflow. The evaporator includes an inlet header configured to receive a cooling fluid, an outlet header configured to discharge the cooling fluid, and a plurality of microchannel tubes in fluid communication with and extending between the inlet header and the outlet header. The microchannel tubes are bent along a bend axis to define a first heat exchanger region on one side of the bend axis and a second heat exchanger region on the other side of the bend axis. The plurality of microchannel tubes of the first heat exchanger region are angled at a non-zero angle relative to the microchannel tubes of the second heat exchanger region about the bend axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
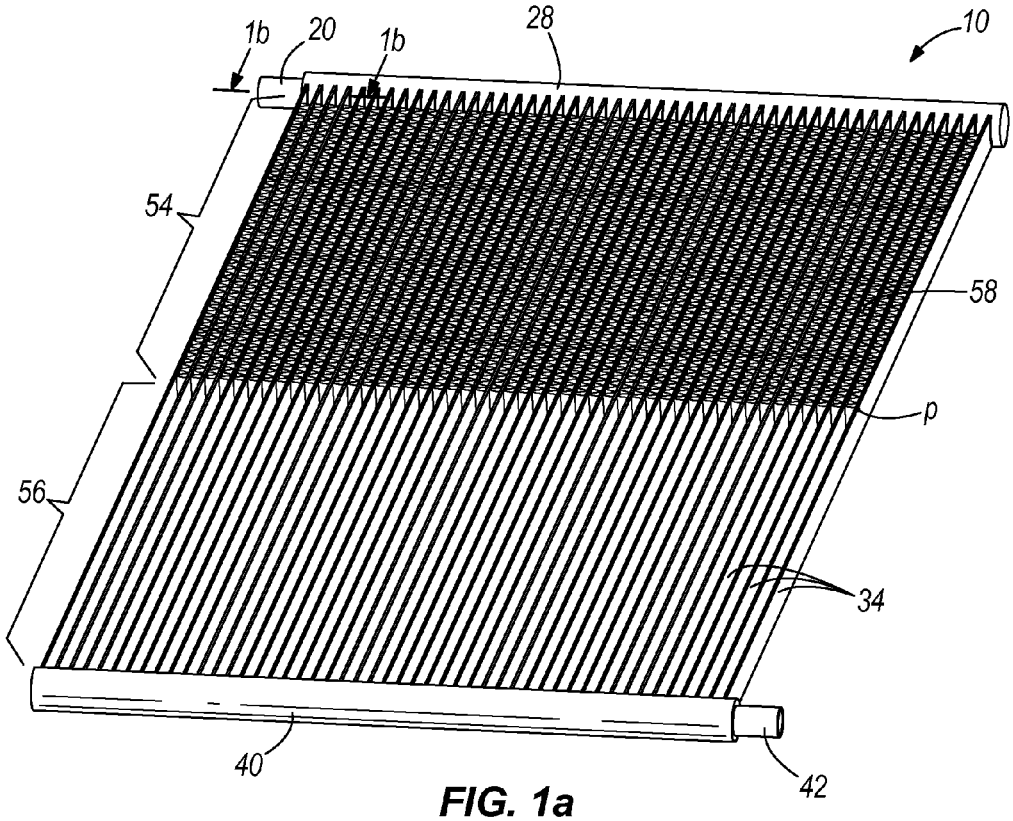
FIG. 1*a* is a perspective view of a microchannel evaporator embodying the invention.

FIG. 1*a* illustrates a heat exchanger or evaporator 10 for use in a refrigeration circuit for cooling an airflow. The evaporator 10 will be described herein in the context of a refrigerated merchandiser but is not so limited in its application and may be used within any cooling system in which heat and moisture are to be removed from an airstream. The evaporator 10 includes an inlet port 20 that is fluidly coupled to refrigeration system piping (not shown) for receiving condensed refrigerant, and an inlet header 28 that is fluidly coupled to the inlet port 20. The inlet header 28 delivers refrigerant to a plurality of spaced apart flat tubes 34, which are further described below. As understood by one of ordinary skill in the art, refrigerant is evaporated within the flat tubes 34 by heat exchange with an airflow passing through the evaporator 10. Evaporated refrigerant collects in an outlet header 40 and is discharged through an outlet port 42 that is fluidly coupled to a compressor or pump (not shown) via additional refrigeration system piping (not shown). In some constructions, the evaporator 10 can include multiple inlet ports along the inlet header 28 and multiple outlet ports along the outlet header 40 that are transversely spaced apart from each other to more uniformly distribute refrigerant to and from the headers 28, 40. The evaporator 10 can also include other devices used for uniformly distributing refrigerant, such as a manifold or baffles within a manifold.

Figure 1B:
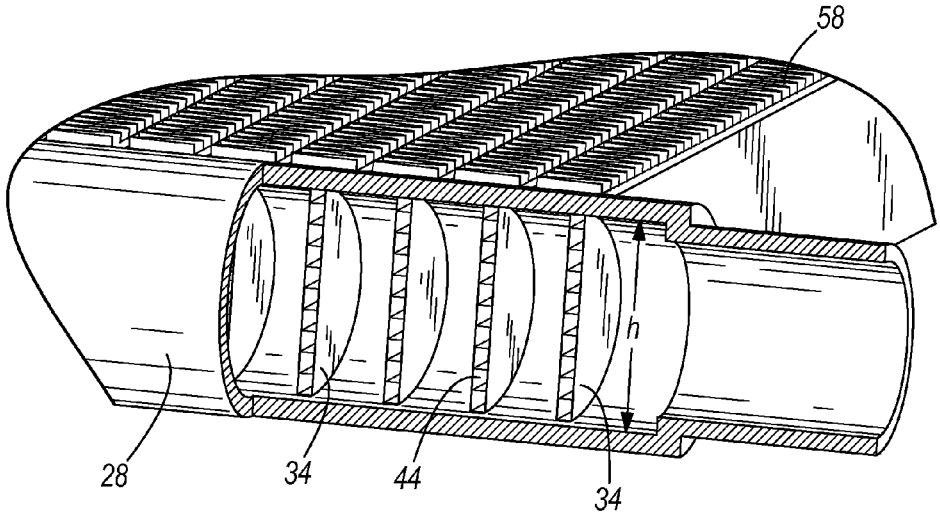
FIG. 1*b* is a section view of a portion of the microchannel evaporator of FIG. 1*a* exposing microchannel tubes.

With reference to FIGS. 1*a* and 1*b*, the flat tubes 34 are fluidly coupled to and extend between the inlet and outlet headers 28, 40. Each flat tube 34 has a height h (FIG. 1*b*) of approximately 22 mm, although the height of the flat tubes 34 can vary substantially, for example, from less than about 10 mm to more than about 40 mm. The flat tubes 34 are spaced apart from each other by approximately 9.5 mm, although the spacing between adjacent flat tubes 34 can vary substantially, for example, from less than about 5 mm to more than about 16 mm. In addition, the tube wall thickness can vary substantially due to material, operating environment, and working pressure requirements, and can range from about 0.1 mm to about 0.5 mm. The flat tubes 34 provide heat transfer with the airflow passing through the evaporator 10 and can be formed from any suitable material and method, for example, extruded aluminum or folded aluminum.

The flat tubes 34 define multiple internal passageways or microchannels 44 that are smaller in size than the internal passageway of a heat exchanger coil in a conventional fin-and-tube evaporator. As illustrated, the microchannels 44 are defined by a rectangular cross-section, although other cross-sectional shapes are possible and considered herein. Each tube 34 has between ten to fifteen microchannels 44, with each microchannel 44 being about 1 mm in height and about 1 mm in width. In other constructions, the microchannels 44 can vary substantially, for example, from as small as 0.5 mm by 0.5 mm to as large as 4 mm by 4 mm. The size and configuration of the microchannels 44 within the tubes 34 can vary to accommodate the variations in tube construction noted above. Accordingly, the tube width is approximately 1.2 mm but may range from less than about 1 mm to more than about 5 mm.

Referring to FIG. 1*a*, the evaporator 10 is defined by a first heat exchanger region 54 extending from the inlet header 28 to a point "p," and a second heat exchanger region 56 extending from the outlet header 40 to the point "p." The second heat exchanger region 56 adjoins the first heat exchanger region 54 at the point "p." As illustrated, the point "p" is located at or near the midpoint of the tubes 34 between the inlet header 28 and the outlet header 40, although the point "p" can be anywhere between the inlet header 28 and the outlet header 40.

With reference to FIGS. 1*a* and 1*b*, the first heat exchanger region 54 and the second heat exchanger region 56 are arranged in series relationship with each other such that refrigerant flows through the first heat exchanger region 54 prior to flowing through the second heat exchanger region 56. The first heat exchanger region 54 includes a plurality of fins 58 that are coupled to and positioned between the tubes 34 along a portion of the length of the tubes 34 (i.e., in the longitudinal direction of the tubes 34). Generally, the fins 58 aid in heat transfer between air passing through the microchannel evaporator 10 and refrigerant flowing within the tubes 34 by increasing the surface area of thermal contact. As illustrated, the fins 58 are generally arranged in a zigzag pattern between the adjacent tubes 34. In the illustrated construction, the fin density measured along the length of the tubes 34 within the first heat exchanger region 54 is between 12 and 24 fins per inch. In other constructions, the fin density within the first heat exchanger region 54 can vary substantially, for example, from less than 3 to more than 24 fins per inch. The fins 58 can also include a plurality of louvers (not shown) formed to provide additional heat transfer area, and may have additional surface features and/or shapes for that purpose (e.g., triangular, wavy, perforated, etc.). Further, the thickness of the fins 58 can vary depending on the desired heat transfer characteristics and other evaporator design considerations. For example, the individual fin thickness measured within the first heat exchanger region 54 is between 0.2 mm and 0.8 mm. In other embodiments of the evaporator 10, the fin thickness can vary from less than 0.2 mm to more than 0.8 mm. Additionally, the fins 58 may vary in height. For example, the fin height measured within the first heat exchanger region 54 is between less than 8 mm and greater than 42 mm.

The second heat exchanger region 56 has a fin density that is less than the fin density of the first heat exchanger region 54. For example, FIG. 1*a* shows that the second heat exchanger region 56 is devoid of fins (i.e., the second heat exchanger region 56 has a fin density of zero fins per inch). Generally, the fins 58 increase the heat transfer potential of the evaporator 10, but the fins 58 also increase the amount of moisture that is condensed from air passing through the evaporator 10. As moisture settles on the fins 58, appreciable amounts of surface frost can form due to the surface temperature of the fins 58 being below the freezing point of water. Frost formation significantly impacts and can impede subsequent airflow through the evaporator 10, which hinders the transfer of heat from the airflow to refrigerant flowing inside the tubes 34. Removing the frost can take a considerable amount of time and its presence may result in an increase in temperature of the air flowing over the heat exchanger such that the corresponding temperature of cooled air delivered from the evaporator may undesirably increase. The elimination of the fins 58 in the second heat exchanger region 56 of the evaporator 10 reduces impeding frost formation in that region and thus minimizes defrost operations for the evaporator 10, which increases the overall efficiency and effectiveness of the evaporator 10.

Figure 1C:
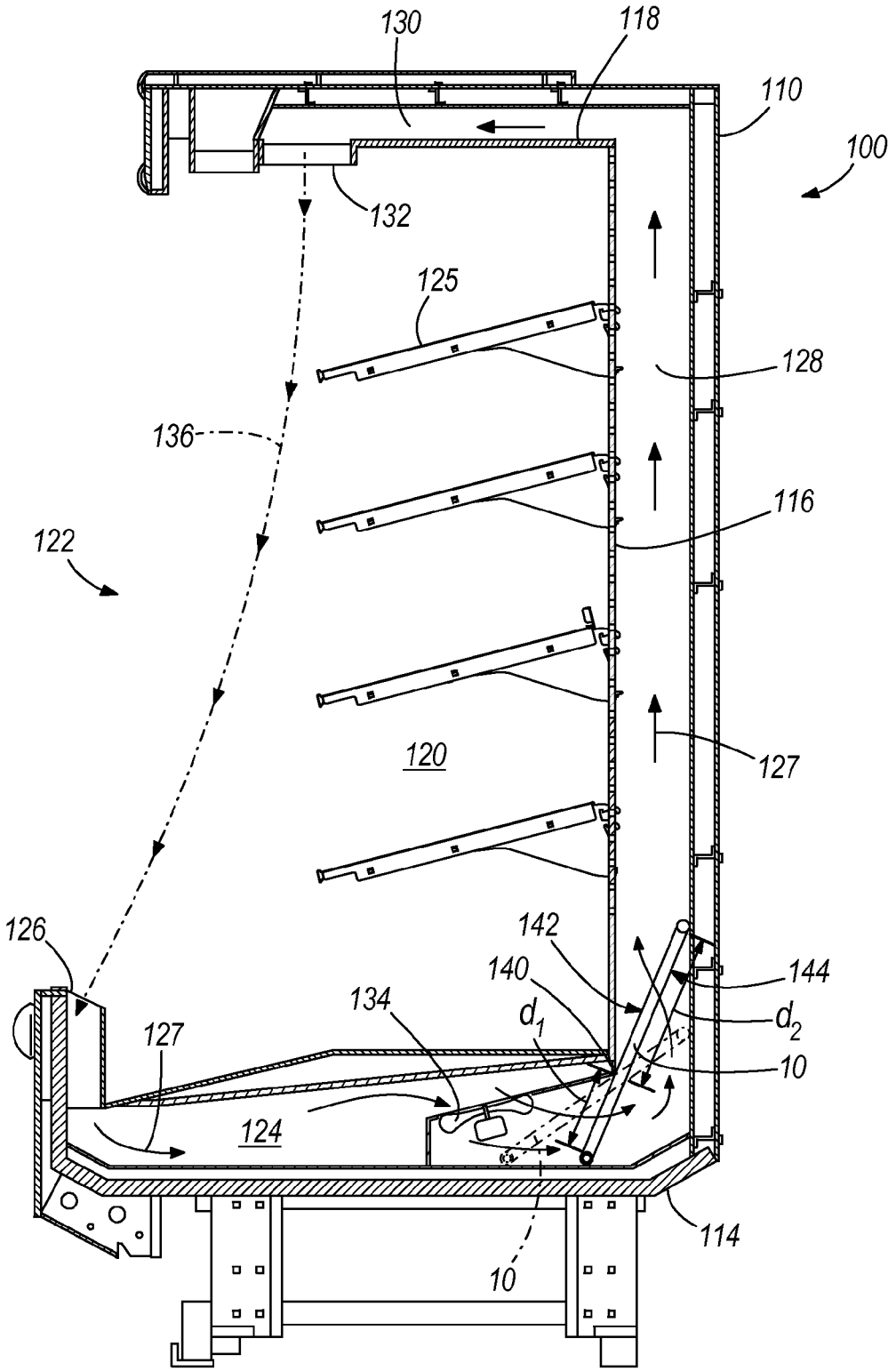
FIG. 1*c* is a side view of a refrigerated merchandiser including the microchannel evaporator of FIG. 1*a*.

FIG. 1*c* shows a refrigerated merchandiser 100 that includes the evaporator 10. The merchandiser 100 includes a case 110 that has a base 114, a rear wall 116, and a canopy or case top 118. The area that is partially enclosed by the base 114, the rear wall 116, and the canopy 118 defines a product display area 120. As illustrated, the product display area 120 is accessible by customers through an opening 122 adjacent the front of the case 110. Shelves 125 are coupled to the rear wall 116 and extend forward toward the opening 122 adjacent the front of the merchandiser 100 to support food product that is accessible by a consumer through the opening 122.

The base 114 defines a lower portion of the product display area 120 and can support a portion of the food product in the case 110. The base 114 further defines a lower flue 124 and includes an inlet 126 located adjacent the opening 122. As illustrated, the lower flue 124 is in fluid communication with the inlet 126 and conducts an airflow 127 substantially horizontally through the base 114 from the inlet 126. The inlet 126 is positioned to receive surrounding air in a substantially vertical direction to direct the surrounding air into the lower flue 124.

As illustrated, the rear wall 116 defines a rear portion of the product display area 120 that includes a rear flue 128 in fluid communication with the lower flue 124. The rear flue 128 directs the airflow 127 vertically through the case 110. In some constructions, the rear wall 116 can include apertures (not shown) that fluidly couple the rear flue 128 with the product display area 120 and that permit at least some of the airflow 127 in the rear flue 128 to enter the product display area 120.

The canopy 118 is disposed substantially above the product display area 120 and defines an upper portion of the product display area 120. The canopy 118 further defines an upper flue 130 and includes an outlet 132 that is in fluid communication with the upper flue 130. The upper flue 130 is in fluid communication with the rear flue 128 and directs the airflow 127 substantially horizontally through the canopy 30 toward the outlet 132.

The lower flue 124, the rear flue 128, and the upper flue 130 are fluidly coupled to each other to define an air passageway that directs the airflow 127 from the inlet 126 to the outlet 132. As illustrated, a fan 134 is positioned in the base 114 in fluid communication with the lower flue 124 to circulate the airflow 127 from the inlet 126 through the outlet 132 in the form of an air curtain 136. The air curtain 136 travels generally downward from the outlet 132 into the product display area 120 across the opening 122 to cool the food product within a desired or standard temperature range (e.g., 32 to 41 degrees Fahrenheit). Generally, the inlet 126 receives at least some of the air curtain 136 that is discharged from the outlet 132. Although not shown, the case 110 can define a secondary air passageway that directs a secondary air curtain (refrigerated or non-refrigerated) from the canopy generally downward across the opening 122 (e.g., to buffer the air curtain 136 to minimize infiltration of ambient air into the product display area 120).

With continued reference to FIG. 1*c*, the lower flue 124 and the rear flue 128 cooperatively define a bend or corner 140 in the air passageway. As illustrated, the evaporator 10 is positioned at the corner 140 to transfer heat from the airflow 127 to refrigerant flowing through the evaporator 10. Stated another way, the evaporator 10 is oriented at a non-zero angle relative to a vertical plane defined by the rear wall 116 such that the evaporator 10 contacts the corner 140. As oriented, the airflow 127 passes substantially horizontally in the lower flue 124 through a first portion of the evaporator 10 before turning the corner 140 and passing substantially vertically through a second portion of the evaporator 10 in the rear flue 128. Specifically, the airflow 127 first passes horizontally through the second heat exchanger region 56 in a generally uniform direction (e.g., rightward as illustrated in FIG. 1*c*) from a front face or side 142 of the evaporator 10. The airflow 127 then passes vertically through the first heat exchanger region 54 in a generally uniform direction (e.g., upward as illustrated in FIG. 1*c*) from a rear face or side 144 of the evaporator 10. In this manner, the airflow sequentially flows through the second heat exchanger region 56 (e.g., without fins 58), and the first heat exchanger region 54 (e.g., with a non-zero fin density).

The location of the evaporator 10 within the merchandiser 100 depends in part on the amount of facial surface area desired with respect to the first heat exchanger region 54 and the second heat exchanger region 56. Referring to FIG. 1*c*, for a given width of evaporator 10, the facial surface area can be defined linearly as the distance $d_1$ of the front face 142 disposed within the horizontally oriented lower flue 124 and the distance $d_2$ of the rear face 144 disposed within the vertically oriented rear flue 128. The distances $d_1$, $d_2$ can correspond to the limits of the regions, 56, 54 and the point "p." For example, FIG. 1*c* shows that the evaporator 10 can be positioned at a relatively steep angle relative to vertical such that the first heat exchanger region 54 presents a relatively small facial surface area ($d_2$) to the airflow path while the second heat exchanger region 56 presents a relatively large facial surface area ($d_1$) to the airflow path. Also, the evaporator 10 can be positioned in the refrigerated merchandiser 100 such that the headers 28, 40 are horizontally or vertically oriented, or at some angle relative to a horizontal plane extending through the base 114.

Figure 2:
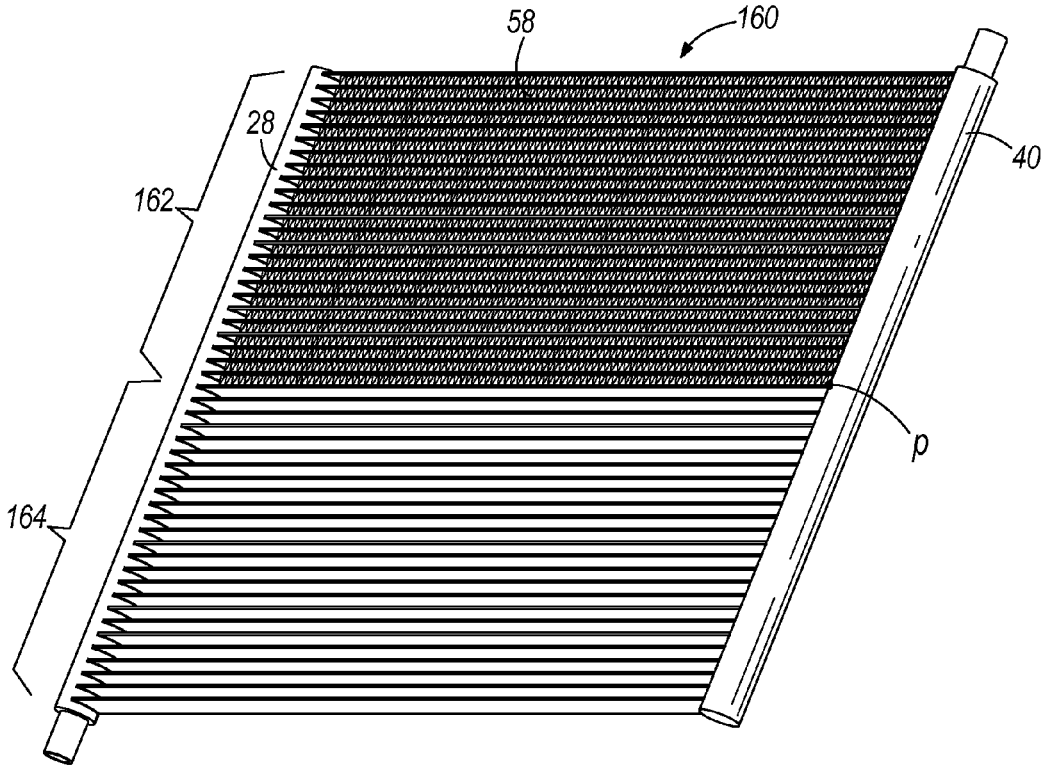
FIG. 2 is a perspective view of another microchannel evaporator embodying the invention.

FIG. 2 shows another evaporator 160 for use with the refrigerated merchandiser 100. Except as described below, the evaporator 160 is the same as the evaporator 10 described with regard to FIGS. 1*a-c*, and common elements are given the same reference numerals. The evaporator 160 includes the inlet header 28 and the outlet header 40, and defines a first heat exchanger region 162 and a second heat exchanger region 164 that meet at a point "p." As illustrated, the point "p" is located at or near the midpoint between the inlet header 28 and the outlet header 40.

The first and second heat exchanger regions 162, 164 are arranged on the evaporator 160 such that the heat exchanger regions 162, 164 are in parallel relationship with each other. In this manner, some refrigerant flows through the first heat exchanger region 162 while the remaining refrigerant flows through the second heat exchanger region 164. In other words, refrigerant flows through both heat exchanger regions 162, 164 simultaneously or concurrently.

The evaporator 160 includes the flat tubes 34 extending between the inlet header 28 and the outlet header 40. As illustrated, the first heat exchanger region 162 includes a plurality of fins 58 that are coupled to and positioned between the tubes 34 along a portion of the length of the tubes 34 (i.e., in the longitudinal direction of the tubes 34). The second heat exchanger region 162 is devoid of fins, although the second heat exchanger region 162 can have a predetermined non-zero fin density based on desired heat transfer characteristics for the evaporator 160.

Figure 3:
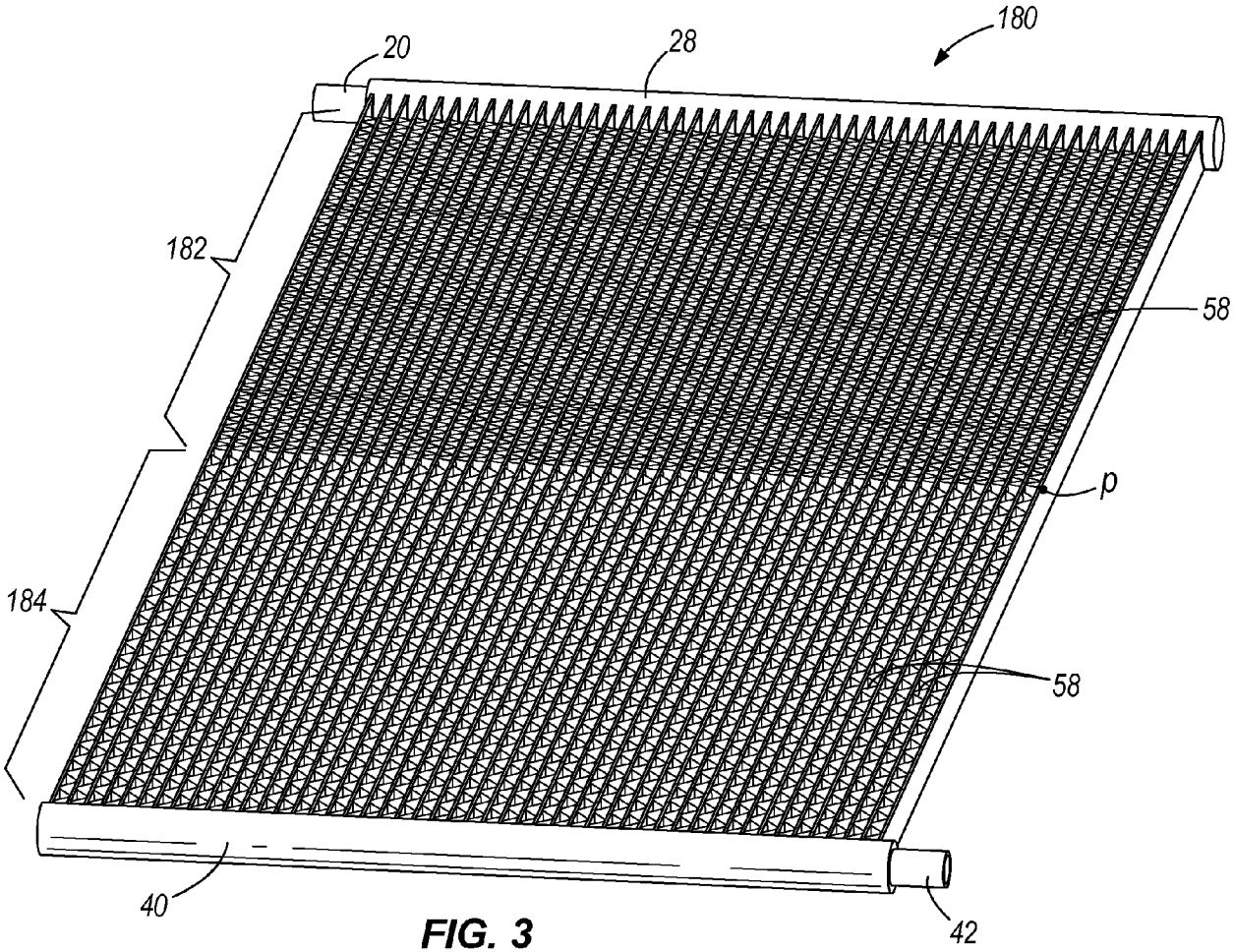
FIG. 3 is a perspective view of another microchannel evaporator embodying the invention.

FIG. 3 illustrates another microchannel evaporator 180 that can be used with the refrigerated merchandiser 100. Except as described below, the microchannel evaporator 180 is the same as the evaporator 10 described with regard to FIGS. 1*a-c*, and common elements have been given the same reference numerals.

The evaporator 180 is defined by a first heat exchanger region 182 extending from the inlet header 28 to the point "p," and a second heat exchanger region 184 extending from the outlet header 40 to the point "p." Each of the first heat exchanger region 182 and the second heat exchanger region 184 includes a predetermined non-zero density of the fins 58. In particular, the first heat exchanger region 182 has a first fin density that is greater than zero and the second heat exchanger region 184 has a second fin density that is greater than zero and less than the first fin density. For example, the first heat exchanger region 182 can have a fin density between approximately 18 and 24 fins per inch and the second heat exchanger region 184 can have a fin density between approximately 12 and 18 fins per inch.

Figure 4A:
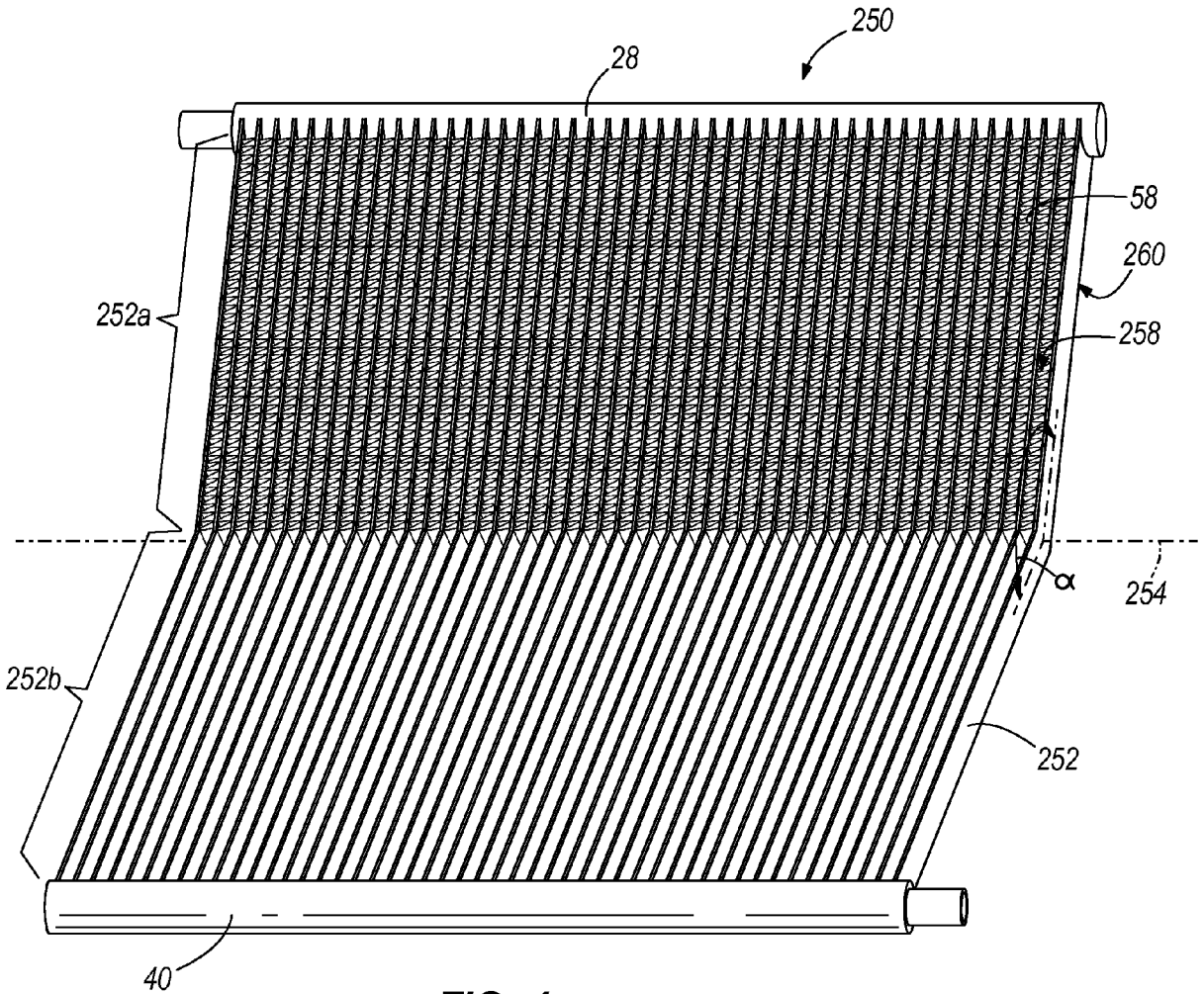
FIG. 4*a* is a perspective view of an angled evaporator embodying the invention.
Figure 4B:
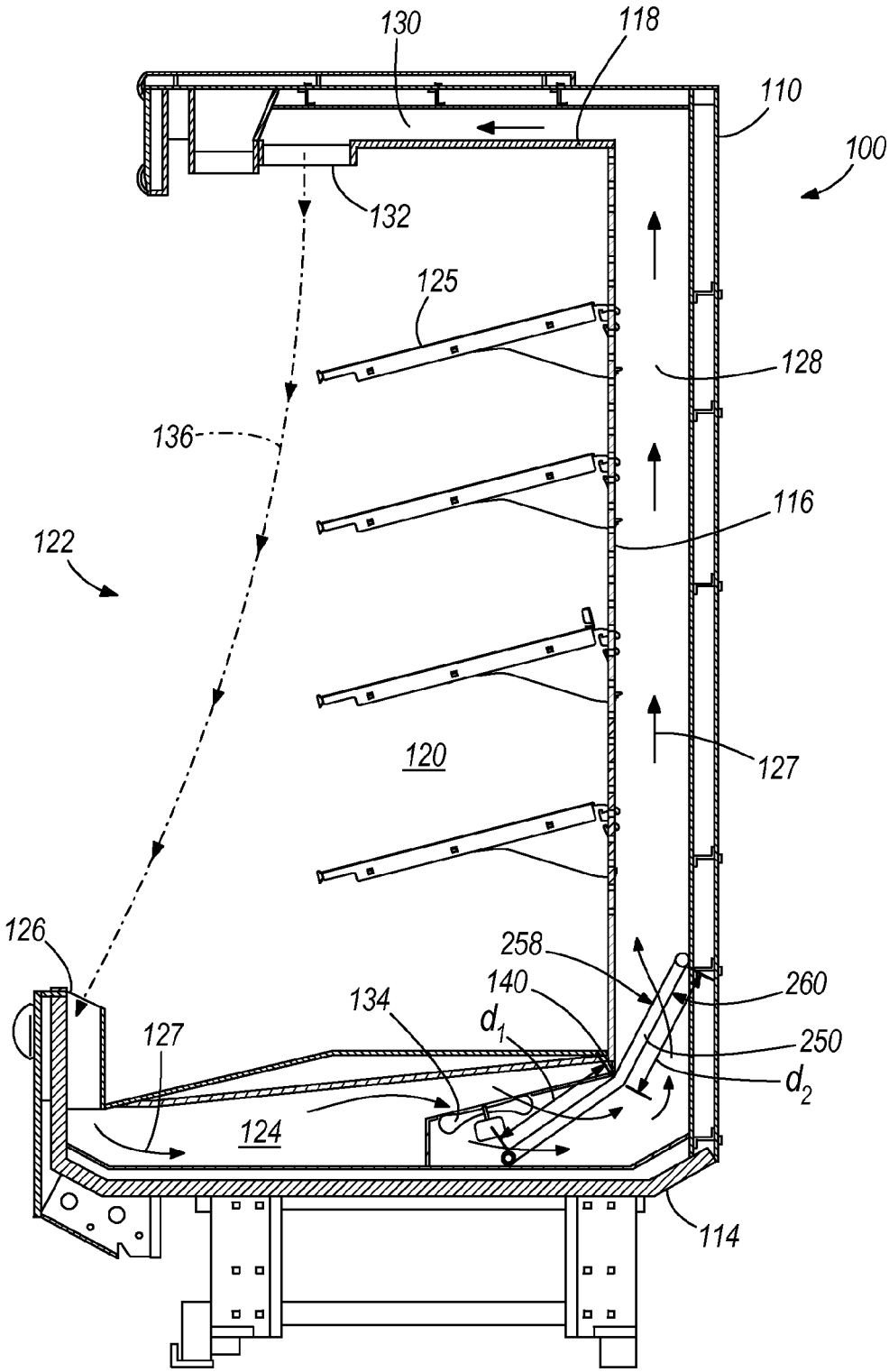
FIG. 4*b* is a side view of a refrigerated merchandiser with the evaporator of FIG. 4*a* in one position within an air passageway.

FIGS. 4*a* and 4*b* illustrate another evaporator 250 that can be used with the refrigerated merchandiser 100. Except as described below, the microchannel evaporator 250 is the same as the evaporator 10 described with regard to FIGS. 1*a-c*, and common elements have been given the same reference numerals.

The evaporator 250 has microchannel tubes 252 that are bent about an axis 254 such that each microchannel tube 252 has a first heat exchanger region 252*a* on one side of the bend axis 254 nearest the inlet header 28 and a second heat exchanger region 252*b* on the other side of the bend axis 254 nearest the outlet header 40. Generally, the bend axis 254 extends orthogonally through the microchannel tubes 252 and parallel to the inlet and outlet headers 28, 40. As illustrated, the bend axis 254 is located at an approximate midpoint between the inlet header 28 and the outlet header 40, although the bend axis 254 can be located anywhere along the microchannel tubes 252 between the inlet and outlet headers 28, 40.

Due to the bend in the microchannel tubes 252, the first heat exchanger region 252*a* is oriented at an angle α relative to the second heat exchanger region 252*b*. As illustrated, the angle α between the first heat exchanger region 252*a* and the second heat exchanger region 252*b* is approximately 140°, although the angle α can be any angle between about 15° and about 180°. Also, due to the bent profile defined by the first and second heat exchanger regions 252*a*, 252*b*, the evaporator 250 has a concave side along a front face 258 and a convex side along a rear face 260.

With continued reference to FIG. 4*a*, the first heat exchanger region 252*a* has a first fin density and the second heat exchanger region 252*b* has a second fin density. As illustrated, the first heat exchanger region 252*a* has fins 58 such that the first heat exchanger region 252*a* is defined by a non-zero fin density, and the second heat exchanger region 252*b* is devoid of fins 58 (i.e., the second heat exchanger region 252*b* is defined by a zero fin density). Generally, the first fin density can be the same as or different from the fin density described with regard to the first heat exchanger regions 54, 182. Likewise, the second fin density associated with the second heat exchanger region 252*b* can be the same as or different from the fin density described with regard to the second heat exchanger region 56 (i.e., no fins) or the second heat exchanger region 184 (e.g., a fin density less than the fin density of the first heat exchanger region 182). For example, the second heat exchanger region 252*b* can have the same fin density as the first heat exchanger region 252*a*.

As illustrated in FIG. 4*b*, the evaporator 250 is positioned in the air passageway of the case 110 such that the bend abuts or is substantially in contact with the corner 140 between the lower flue 124 and the rear flue 128. Although the evaporator 250 is shown with the front face 258 (i.e., the concave side of the evaporator 250) of the microchannel tubes 252 abutting the corner 140, the orientation of the evaporator 250 can be reversed such that the rear face 260 (i.e., the convex side of the evaporator 250) abuts or is substantially in contact with the corner 140. Also, the evaporator 250 can be positioned in the air passageway such that either the heat exchanger region 252*a* or the heat exchanger region 252*b* is near or in contact with or substantially abutting the corner 140.

As oriented, the airflow 127 passes substantially horizontally in the lower flue 124 through the second heat exchanger region 252*b* from the front face 258 to the rear face 260 before turning the corner 140 and passing substantially vertically through the first heat exchanger region 252*a* from the rear face 260 to the front face 258. In this manner, the airflow 127 sequentially flows through the second heat exchanger region 252*b* (e.g., with a zero fin density, a low fin density, etc.) and the first heat exchanger region 252*a* (e.g., with a non-zero fin density).

With continued reference to FIG. 4*b*, the location of the bend axis 254 and the value of the angle α depend in part on the desired facial surface area to be encountered by the airflow 127 relative to the first heat exchanger region 252*a* and the second heat exchanger region 252*b*. The facial surface area can be defined linearly for a given width of the evaporator 250 as the distance $d_1$ of the front face 258 disposed within the lower flue 124 and the distance $d_2$ of the rear face 260 disposed within the rear flue 128. The distances $d_1$, $d_2$ correspond to the respective lengths of the first and second heat exchanger regions 252*b*, 252*a* between the inlet and outlet headers 28, 40.

Figure 4C:
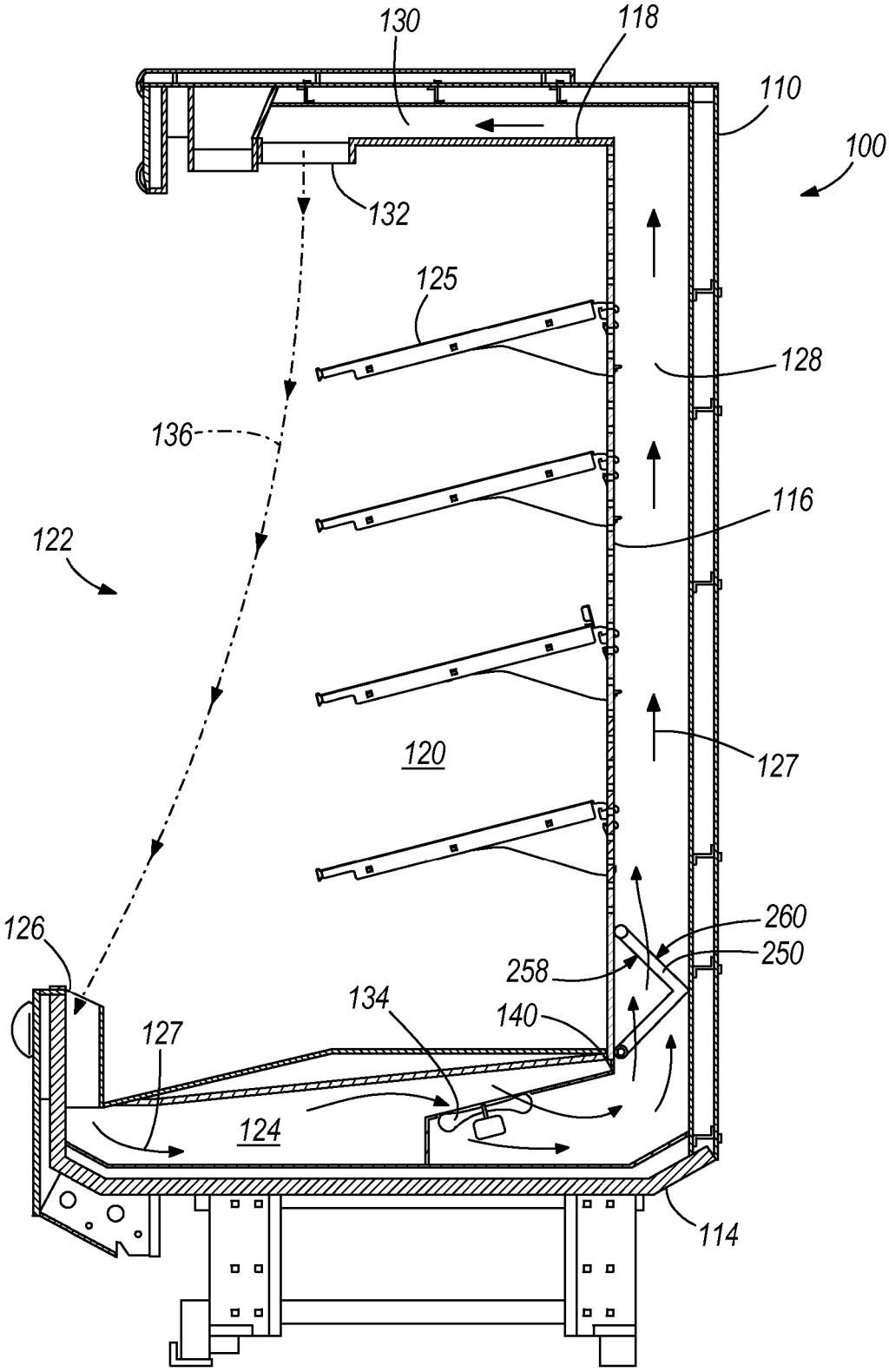
FIG. 4*c* is a side view of a refrigerated merchandiser with the evaporator of FIG. 4*a* in another position within the air passageway.

In some instances, the evaporator 250 can be positioned, oriented, or disposed wholly within the lower flue 124, the rear flue 128, or the upper flue 130. For example, FIG. 4*c* shows the evaporator 250 positioned in the air passageway of the case 110 within the rear flue 128. The airflow 127 flows through the second heat exchanger region 252*b* in the rear flue 128 from the rear face 260 to the front face 258 and then passes through the first heat exchanger region 252*a* from the front face 258 to the rear face 260.

Figure 5A:
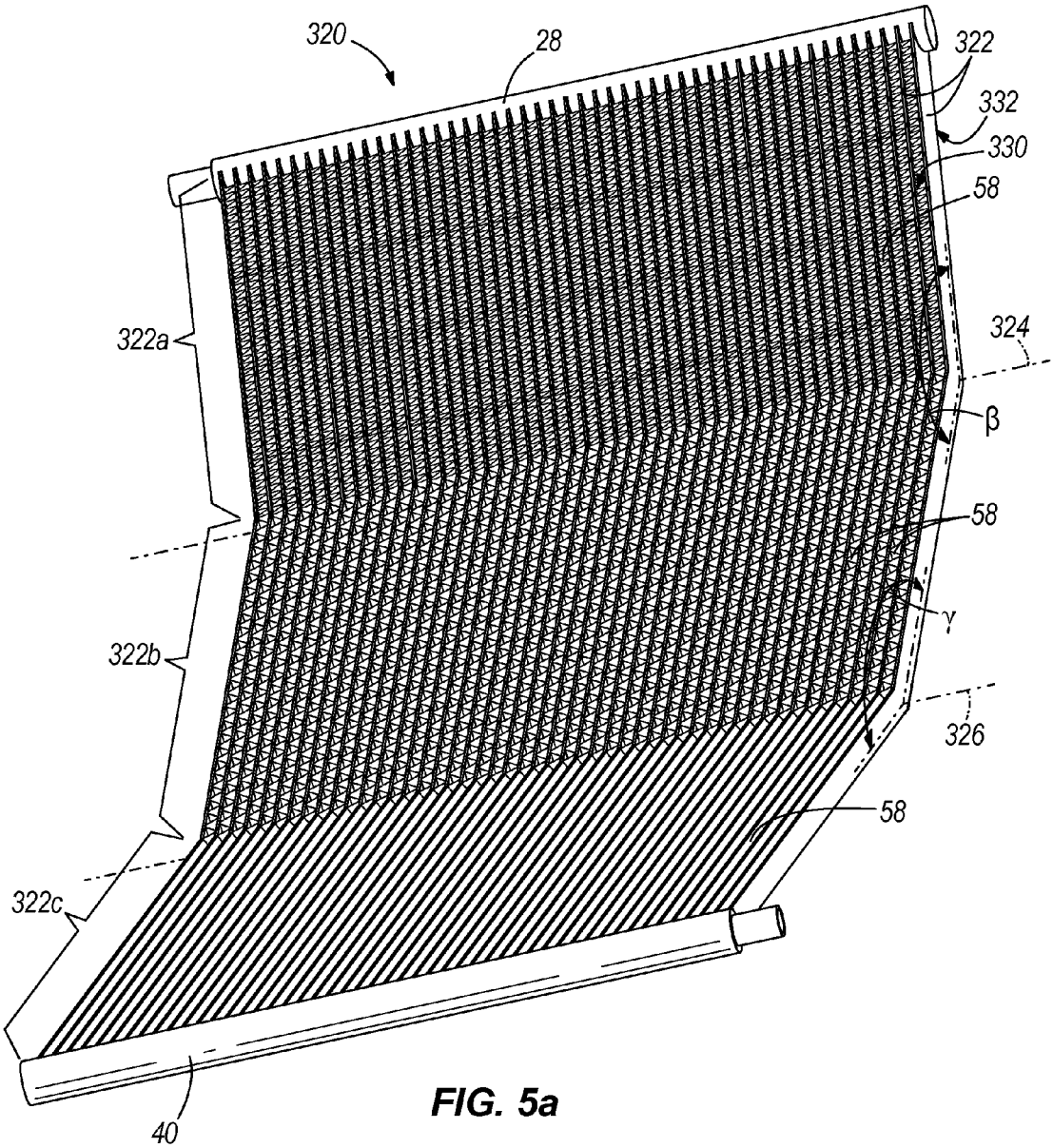
FIG. 5*a* is a perspective view of an evaporator having multiple angles embodying the invention.
Figure 5B:
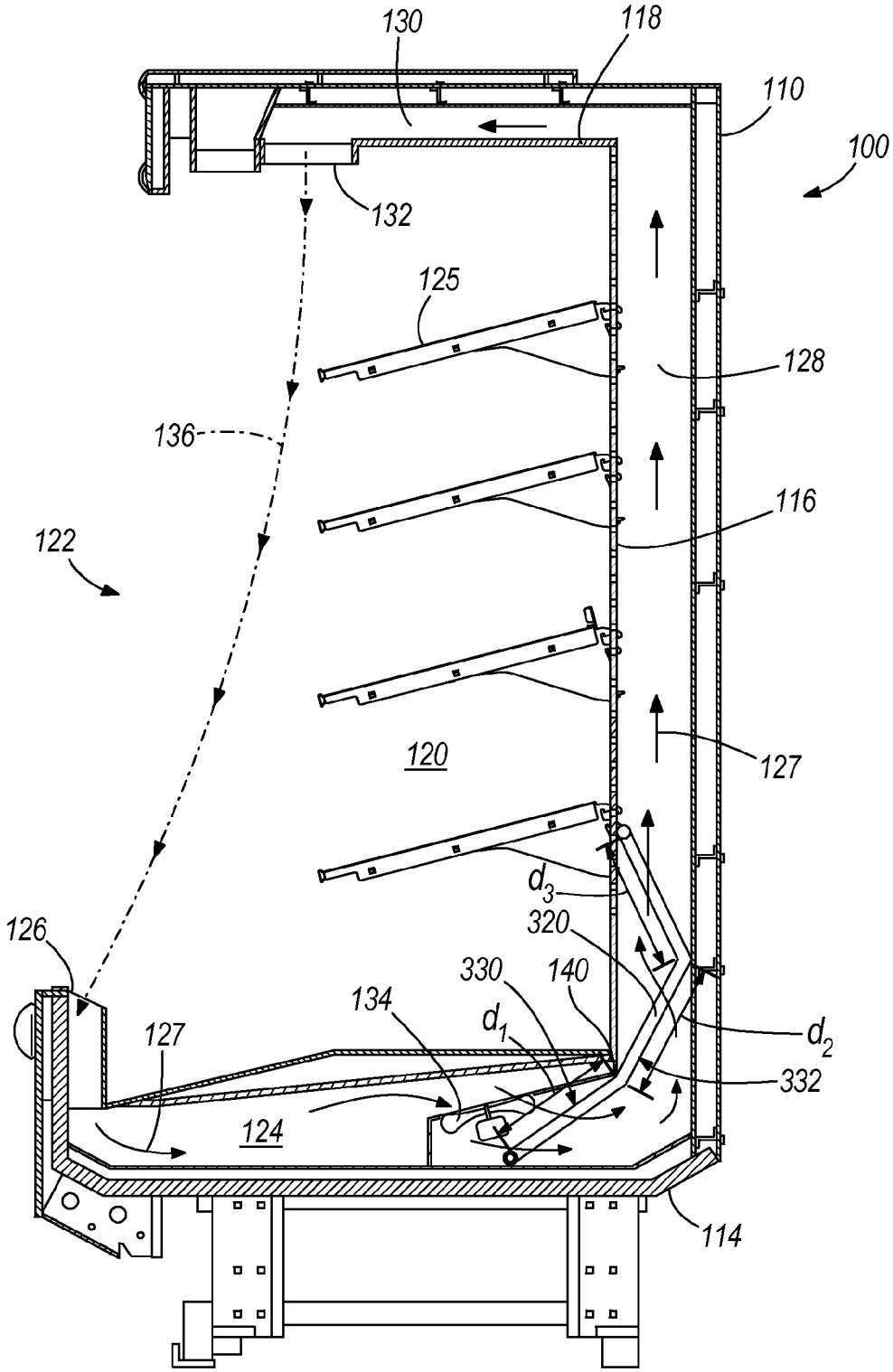
FIG. 5*b* is a side view of a refrigerated merchandiser with the evaporator of FIG. 5*a*.

FIGS. 5*a* and 5*b* illustrate another evaporator 320 that can be used with the refrigerated merchandiser 100. Except as described below, the microchannel evaporator 320 is the same as the evaporator 250 described with regard to FIGS. 1*a-c*, and common elements have been given the same reference numerals.

The evaporator 320 has microchannel tubes 322 that are bent about a first bend axis 324 and a second bend axis 326 such that each microchannel tube 322 has a first heat exchanger region 322*a* between the bend axis 324 and the inlet header 28, a second heat exchanger region 322*b* between the bend axis 324 and the bend axis 326, and a third heat exchanger region 322*c* between the bend axis 326 and the outlet header 40. Generally, the bend axes 324, 326 extend orthogonally through the microchannel tubes 322 parallel to the inlet and outlet headers 28, 40. As illustrated, the bend axes 324, 326 are located such that the length of each heat exchanger region 322*a-c* is approximately one-third of the overall length of the tubes 322. In other constructions, the heat exchanger regions 322*a-c* can have the same or different lengths relative to each other.

The first heat exchanger region 322*a* is oriented at an angle β relative to the second heat exchanger region 322*b*. As illustrated, the angle β between the first heat exchanger region 322*a* and the second heat exchanger region 322*b* is approximately 120°, although the angle β can be any angle between about 90° and 180°. The second heat exchanger region 322*b* is oriented at an angle γ relative to the third heat exchanger region 322*c*. As illustrated, the angle γ between the second heat exchanger region 322*b* and the third heat exchanger region 322*c* is approximately 140°, although the angle γ can be any angle between about 120° and 180°. Due to the bent profile defined by the heat exchanger regions 322*a*, 322*b*, 322*c*, the evaporator 320 has a concave side along a front face 330 and a convex side along a rear face 332.

With continued reference to FIG. 5*a*, the first heat exchanger region 322*a* has a first fin density, the second heat exchanger region 322*b* has a second fin density, and the third heat exchanger region 322*c* has a third fin density. As illustrated, the first heat exchanger region 322*a* includes fins 58 defining a first fin density, the second heat exchanger region 322*b* includes fins 58 defining a second fin density, and the third heat exchanger region 322*c* is devoid of fins 58 (i.e., the third heat exchanger region 322*c* is defined by a fin density of zero). Generally, the first fin density can be the same as or different from the fin density described with regard to the first heat exchanger regions 54, 182. The second fin density associated with the second heat exchanger region 322*b* can be the same as or different from the fin density described with regard to the second heat exchanger region 184 (e.g., a fin density less than the fin density of the first heat exchanger regions 54, 182).

As illustrated in FIG. 5*b*, the evaporator 320 is positioned in the air passageway of the case 110 such that the bend about the second bend axis 326 abuts or is substantially in contact with the corner 140 between the lower flue 124 and the rear flue 128. In some constructions, the evaporator 320 can be positioned in the air passageway such that the bend about the first bend axis 324 abuts or is in contact with the corner 140. In other constructions, the evaporator 320 can be positioned in the air passageway such that the heat exchanger region 322*b* is in contact with or substantially abuts the corner 140.

As oriented, the airflow 127 passes substantially horizontally in the lower flue 124 through the third heat exchanger region 322*c* from the front face 330 to the rear face 332 before turning the corner 140 and passing substantially vertically through the second heat exchanger region 322*b* (from the rear face 332 to the front face 330) and the first heat exchanger region 332*a* (from the front face 330 to the rear face 332). In this manner, the airflow 127 sequentially flows through the third heat exchanger region 322*c* (e.g., with a zero fin density), the second heat exchanger region 322*b* (e.g., with a low fin density) and the first heat exchanger region 322*a* (with a higher fin density).

With continued reference to FIG. 5*b*, the location of the bend axis 324 and the value of the angle β depend in part on the desired facial surface area to be encountered by the airflow 127 relative to the first heat exchanger region 322*a*, the second heat exchanger region 322*b*, and the third heat exchanger region 322*c*. The facial surface area can be defined linearly for a given width of the evaporator 320 as the distance $d_1$ of the front face 330 disposed within the lower flue 124, the distance $d_2$ of the rear face 332 disposed within the rear flue 128, and the distance $d_3$ of the front face 330 disposed within the rear flue 128. The distances $d_1$, $d_2$, and $d_3$ correspond to the respective lengths of the third, second, and first heat exchanger regions 322*c*, 322*b*, and 322*a*, respectively. Though three regions are illustrated in FIGS. 4*a* and 4*b*, more than three zones are within the scope of the invention.

In operation, as air passes through the heat exchanger regions 56, 164, 184, 252*b*, 322*c* (as previously described), contact of the air with the tubes 34, and contact of the air with the lower density fins 58 of the respective heat exchanger regions depending on the evaporator design, lowers the dew point of the air and removes a substantial portion of the latent heat, or moisture. This moisture condenses and freezes on prolonged contact with the tubes or fins of the heat exchanger regions 56, 164, 184, 252*b*, 322*c*. Because these heat exchanger regions generally have a low fin density, if any fins at all, any frost that forms within these regions does not substantially impede the flow of air. The air that has passed through these heat exchanger regions 56, 164, 184, 252*b*, 322*c* has, as a result, a lower moisture level. Therefore, as this air passes through heat exchanger regions 54, 162, 182, 252*a*, 322*a* (as previously described) very little frost will form in these regions as the air temperature is additionally reduced through sensible cooling. In the evaporator 320, the heat exchanger region 322*b* permits additional moisture to be removed from the airflow prior to contact with heat exchanger region 322*a*. With less frost formation on the heat exchanger regions 54, 162, 182, 252*a*, 322*a* to hinder continued airflow through the heat exchangers, the frequency of defrost operations can be reduced.

As desired, several evaporators (e.g., two evaporators) can be connected together to provide cooling for the refrigerated merchandiser 100 (e.g., grouped in series flow in a single or double row assembly, or grouped in parallel flow in a single or double row).

Various features and advantages of the invention are set forth in the following claims.

What is claimed is:

1. A cooling system comprising:

a first flue and a second flue cooperatively defining an air passageway;

a fan disposed in the air passageway to generate an airflow through the first and second flue; and an evaporator in communication with at least one of the first flue and the second flue for cooling the airflow, the evaporator comprising an inlet header configured to receive a cooling fluid;

an outlet header configured to discharge the cooling fluid; and a plurality of microchannel tubes in fluid communication with and extending between the inlet header and the outlet header, the microchannel tubes defining a first side of the heat exchanger between the inlet header and the outlet header and an opposed second side of the heat exchanger between the inlet header and the outlet header, wherein the first and second flue define a bend in the air passageway, and further wherein the evaporator is positioned at the bend such that the airflow passes from the first side to the second side in a first direction and then passes from the second side to the first side in a second direction different from the first direction.

2. The system of claim 1, wherein the evaporator is defined by a first heat exchanger region that extends from one of the outlet header and the inlet header to a point between the inlet header and the outlet header and a second heat exchanger region that extends from the other of the outlet header and the inlet header to the point.

3. The system of claim 2, wherein the first heat exchanger region has a plurality of fins defining a first density and the second heat exchanger region has a plurality of fins defining a second fin density that is different from the first fin density.

4. The system of claim 3, wherein the second fin density is less than the first fin density.

5. The system of claim 3, wherein the first fin density is between about 3 fins per inch and about 24 fins per inch.

6. The system of claim 2, wherein the first heat exchanger region has a plurality of fins and the second heat exchanger region is devoid of fins.

7. The system of claim 2, wherein the evaporator is disposed within the air passageway such that the airflow generated by the fan passes through the first heat exchanger region only after passing through the second heat exchanger region.

8. The system of claim 1, wherein the plurality of microchannel tubes extends linearly between the inlet header and the outlet header.

* * * * *